US005895297A

United States Patent [19]

Ivan

[11] Patent Number: 5,895,297

[45] Date of Patent: Apr. 20, 1999

[54] CABLE INTERCONNECTION ASSEMBLY

[75] Inventor: William John Ivan, Woodbridge, N.J.

[73] Assignee: Lucent Technologies, Inc., Murray Hill, N.J.

[21] Appl. No.: 08/805,632

[22] Filed: Feb. 26, 1997

[51] Int. Cl.[6] ..... H01R 9/22

[52] U.S. Cl. ..... 439/712; 439/76.1

[58] Field of Search ..... 439/76.1, 709, 439/712, 719, 922, 49, 638, 639, 59; 379/327

[56] References Cited

U.S. PATENT DOCUMENTS

| | | | |
|---|---|---|---|
| 3,728,667 | 4/1973 | Richelmann | 439/76.1 |
| 4,390,219 | 6/1983 | Beehler | 439/76.1 |
| 4,585,284 | 4/1986 | Koser et al. | 439/76.1 |
| 5,026,293 | 6/1991 | Wilson | 439/76.1 |
| 5,253,140 | 10/1993 | Inoue et al. | 439/709 |

*Primary Examiner*—Gary Paumen
*Assistant Examiner*—Tho Dac Ta
*Attorney, Agent, or Firm*—Michael Y. Epstein; Henry I Schanzer

[57] ABSTRACT

A connector assembly for non-permanently interconnecting wires from respective cables comprises a box-like structure including a rear wall, side walls and a front wall formed from a plurality of replaceable front wall modules. Connectors at an end of cables extending into the box are removably mounted within respective ones of a plurality of side-by-side slots in the rear wall with the connector terminals facing towards the box front wall. Each front wall module comprises a front wall plate, a printed circuit board including forwardly projecting terminals extending entirely through the front wall plate for being accessible at the front of the box, and a mating connector mounted on the circuit board and having terminals connected, via conductive paths on the circuit board, to the forwardly extending terminals. The printed circuit board is mounted on a rearwardly facing surface of the front wall plate with the mating conductor thereon facing towards, and thus moveable into engagement with a rear wall mounted cable connector, when the wall module is mounted in the assembly box.

7 Claims, 7 Drawing Sheets

CABLE INTERCONNECTION ASSEMBLY

BACKGROUND OF THE INVENTION

This invention relates to connector assemblies for electrically and mechanically interconnecting a plurality of wires in a first cable to respective wires in a second cable.

There are many instances where it is required to interconnect wires from one cable to corresponding wires from another cable. For example, in an office building it is known in advance that a plurality of telephone lines from within the building must be individually connected to wires in cables from a telephone central office. However, until the building is occupied, and even after (in response to changes in usage), it is not known which particular telephone lines are to be connected to which cable lines. Thus, cable interconnection assemblies are provided at which different cables are terminated and which provide means for selectively, and on a non-permanent basis, interconnecting the various wires of the various cables.

FIG. 1 herein, for example, shows a presently used interconnecting arrangement. An "internal" cable 10 from, say, within an office building, terminates in a known type of connector 12 providing exposed terminals (not visible) electrically connected to respective wires within the cable. The connector 12 is connected, in turn, to a connector 18 of a prefabricated wiring harness 14 including a plurality of insulated wires 16 extending loosely from an end of a cable 17 of the wires. The exposed wires 16 are generally flexible and of suitable length for being first hand trimmed and then individually threaded into wire slots 20 within a known "index strip" 22. The index strip can be mounted, for example, on a flat panel mounted on a wall of the building. Connectors 24 of a known type are then snapped onto the index strip 22 for firmly securing the wires 16 within the slots 20 and for making electrical contacts to the wires. Each wire 16 is thus individually accessible at a front end of the connector 24 and groups of "external" wires 26 connected within known "patching" connectors 25 are then connected to the building "internal" wires by snapping the connectors 25 in place on the connectors 24.

Advantages of the arrangement shown are that the components thereof are easy to handle and mount in place and changes in wiring connections can readily be made.

Disadvantages, however, are that the hand trimming and individual threading of the wire ends into the respective slots is a relatively slow process. Also, the wire harness 14 is relatively unsightly when exposed to view on the building wall and provides relatively poor protection of the wire contacts against dirt.

These disadvantages are addressed in accordance with this invention.

SUMMARY OF THE INVENTION

A hollow, closeable box comprises a rear wall surrounded by side walls defining a front opening. The rear wall includes a plurality of side-by-side slots each for receipt of a cable terminating connector, and each rear wall slot is in alignment with a corresponding one of a plurality of side-by-side slots through one of the box side walls. In use, a cable connector is rigidly but removably secured in each rear wall slot by means of, e.g., snap-action fasteners, and the cable extending from each cable connector exits the box through a corresponding side wall slot.

The box opening is closed by a plurality of "front wall" modules each comprising three components: a connector module including a plurality of side-by-side wire terminals extending forwardly of a "front wall" plate; a printed circuit board comprising a flat plate having a pattern of electrically conductive paths on a surface thereof; and a "mating" connector for mating with a rear wall mounted cable connector and including a plurality of terminals for electrical connections to the connector module terminals via the printed board conductive paths.

Each front wall module is mounted on the box by disposing the connector module front wall plate parallel to the box rear wall and extending laterally across the open space of the box. Several front wall modules are preferably used, in correspondence with the number of rear wall slots, with the connector module front wall plates in side-by-side, co-planar relationship for closing the front opening of the box.

In one embodiment, the circuit board flat plate is disposed parallel to and flush against the connector module front wall plate, hence parallel to the box rear wall. In another embodiment, the circuit board flat plate extends transversely rearwardly from the connector module front wall plate. In both embodiments, the respective mating connectors are mounted on the circuit board flat plates to face inwardly of the box for direct mating of each mating connector with a respective rear wall mounted cable connector.

DESCRIPTION OF THE DRAWING

All the Figures are in perspective but not necessarily to scale and partly schematic.

DESCRIPTION OF PREFERRED EMBODIMENTS OF THE INVENTION

Figure 2:
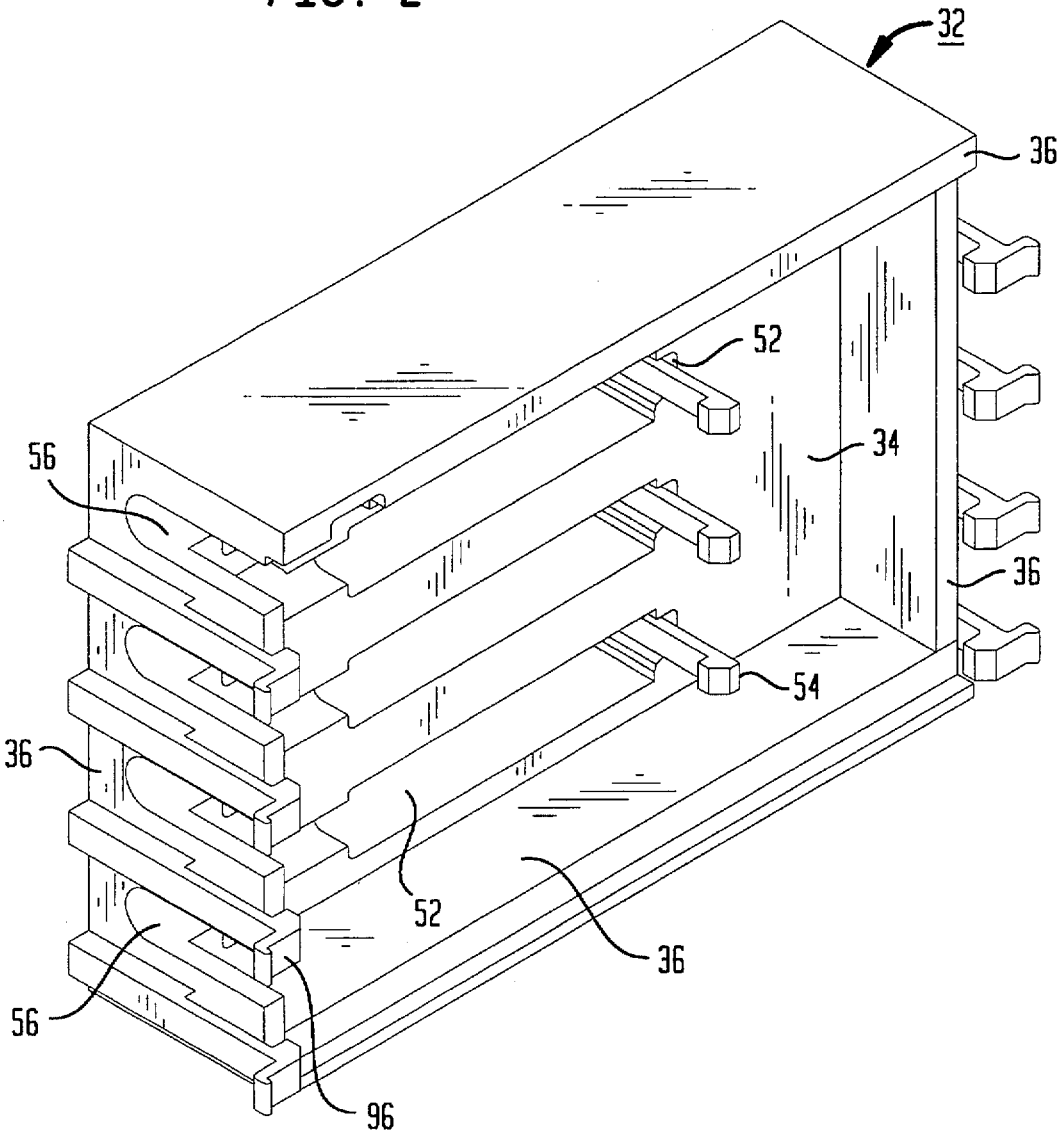
FIG. 2 shows a base member portion of a cable interconnection assembly according to the present invention.
Figure 3:
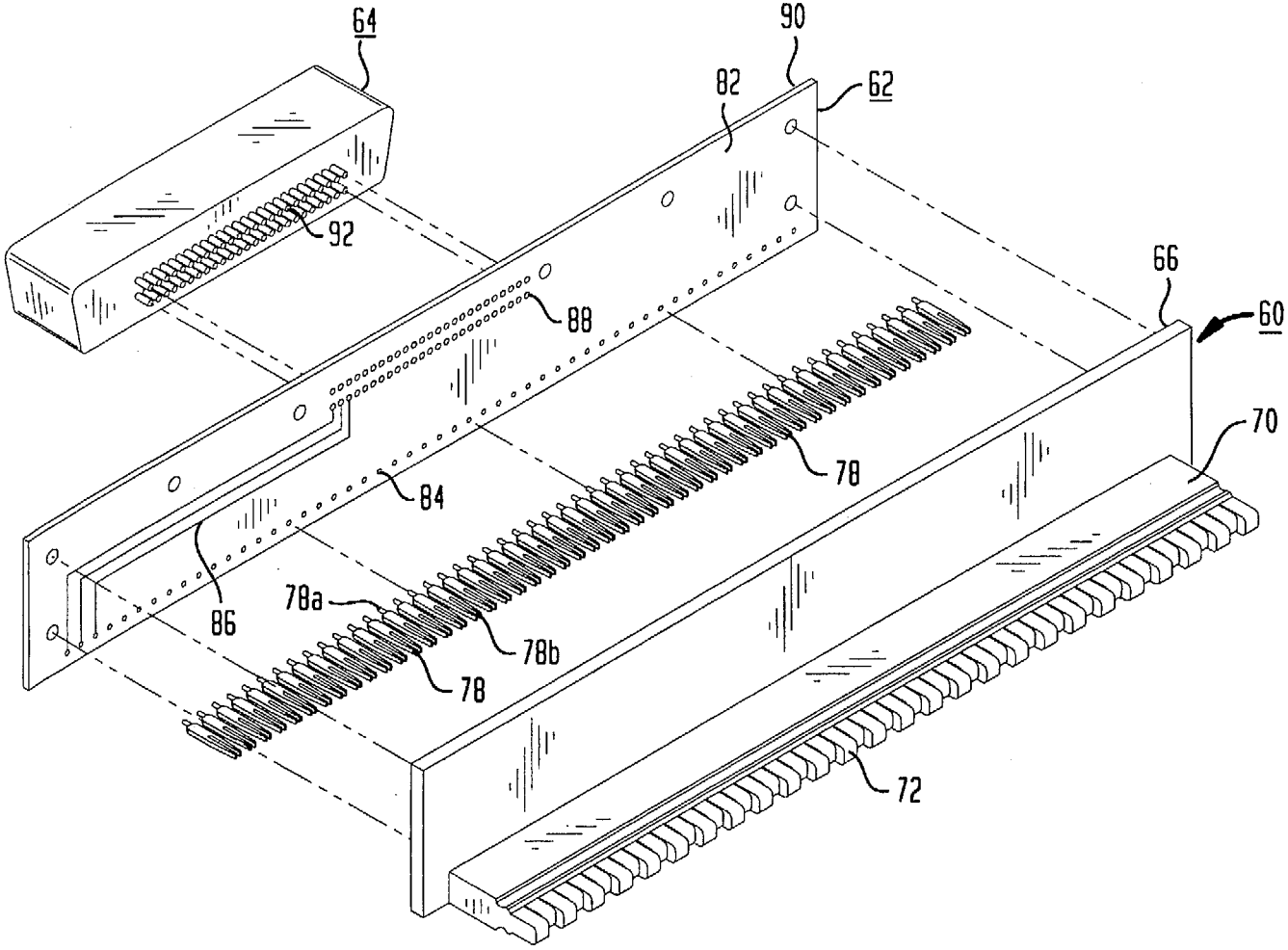
FIG. 3 shows, exploded and partially broken away, a front wall module for use with the base member shown in FIG. 2.
Figure 4:
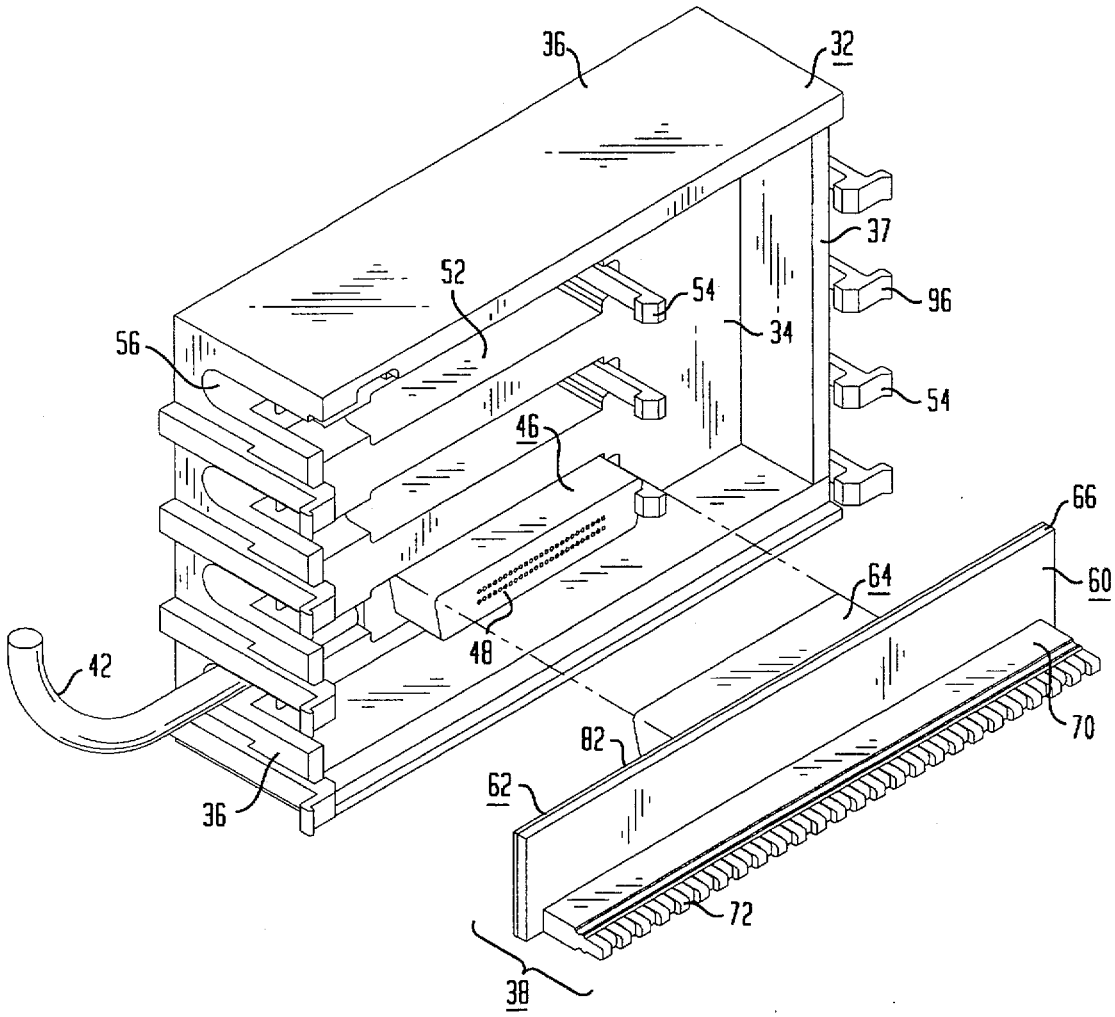
FIG. 4 shows the front wall module shown in FIG. 3 assembled together and in position for being mounted on the base member.
Figure 5:
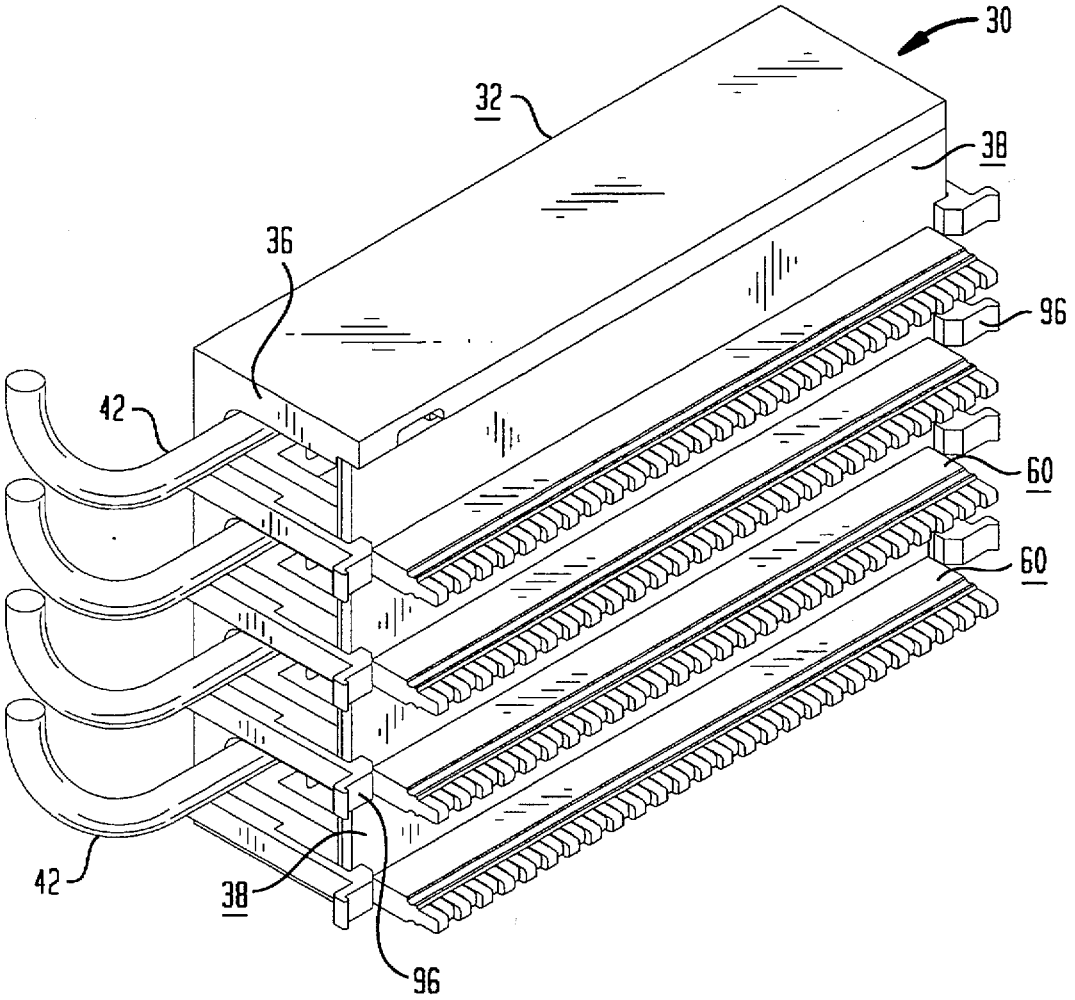
FIG. 5 shows an assembled together assembly according to this invention including four cables extending into the assembly.

The components of a cable interconnection assembly are shown in FIGS. 2–4 and a fitted together assembly 30 is shown in FIG. 5. The assembly 30 is box-like in that it includes a base member 32 (FIG. 2) comprising a rear wall 34 surrounded by side walls 36 and a removable front wall (FIG. 5) formed from a plurality of "front wall" modules 38. (Terms such as "rear", "front" and (hereinafter) "forwardly" and "rearwardly", and the like, are used herein for ease of description and not by way of limitation.)

The assembly 30 is for connecting respective wires in a number of "internal" cables 42 (FIG. 5) entering the assembly through a side wall 36 to respective "external" wires (such as shown at 26 in FIG. 1) connected to the assembly front wall modules 38. The connections to the "external" wires are described hereinafter. Each of the internal cables 42 terminates in a cable connector 46 (FIG. 4) of known type (e.g., a miniature ribbon) including a plurality of terminals in the form of plugs and/or receptacles (shown schematically at 48) accessible at one side of the connector and electrically connected to respective wires in the cable. In this embodiment, as described hereinafter, the terminals 48 are of the known leaf spring type. Other types of connectors can be used.

The base member 32 is shown by itself in FIG. 2. It can be of any number of different materials, but it is preferably of a light-weight, molded plastic material, e.g., an injection molded polycarbonate known as Bayer Makrolon. Disposed within the base member rear wall 34 is a plurality of side-by-side slots 52. The slots 52 serve as receptacles for removably receiving (FIG. 4) connectors 46 at the ends of cables 42 and, to this end, a pair of snap-action latches 54 is disposed at opposite ends of each slot 52. The slot 52, latch 54 arrangements are the presently preferred connector receptacles but, because different types of connectors are commonly used with different types of connector receptacles, other known connector receptacles can be used on the base member 32.

Each rear wall slot 52 (FIG. 2) is aligned with a corresponding slot 56 extending entirely through one (or more) of the side walls 36 adjoining the rear wall 34. As shown in FIG. 4, the cable 42 connected to each connector 46 disposed within a respective rear wall slot 52 extends outwardly from the base member 32 through a corresponding aligned side wall slot 56.

As mentioned, the removable front wall of the assembly 30 is formed from a plurality of front wall modules 38 each comprising three principal components as shown in FIGS. 3 and 4. The three components are a connector module 60, a printed circuit board 62, and a "mating" connector 64 for connection to a connector 46 (FIG. 4) mounted on the base member rear wall 34.

Figure 1:
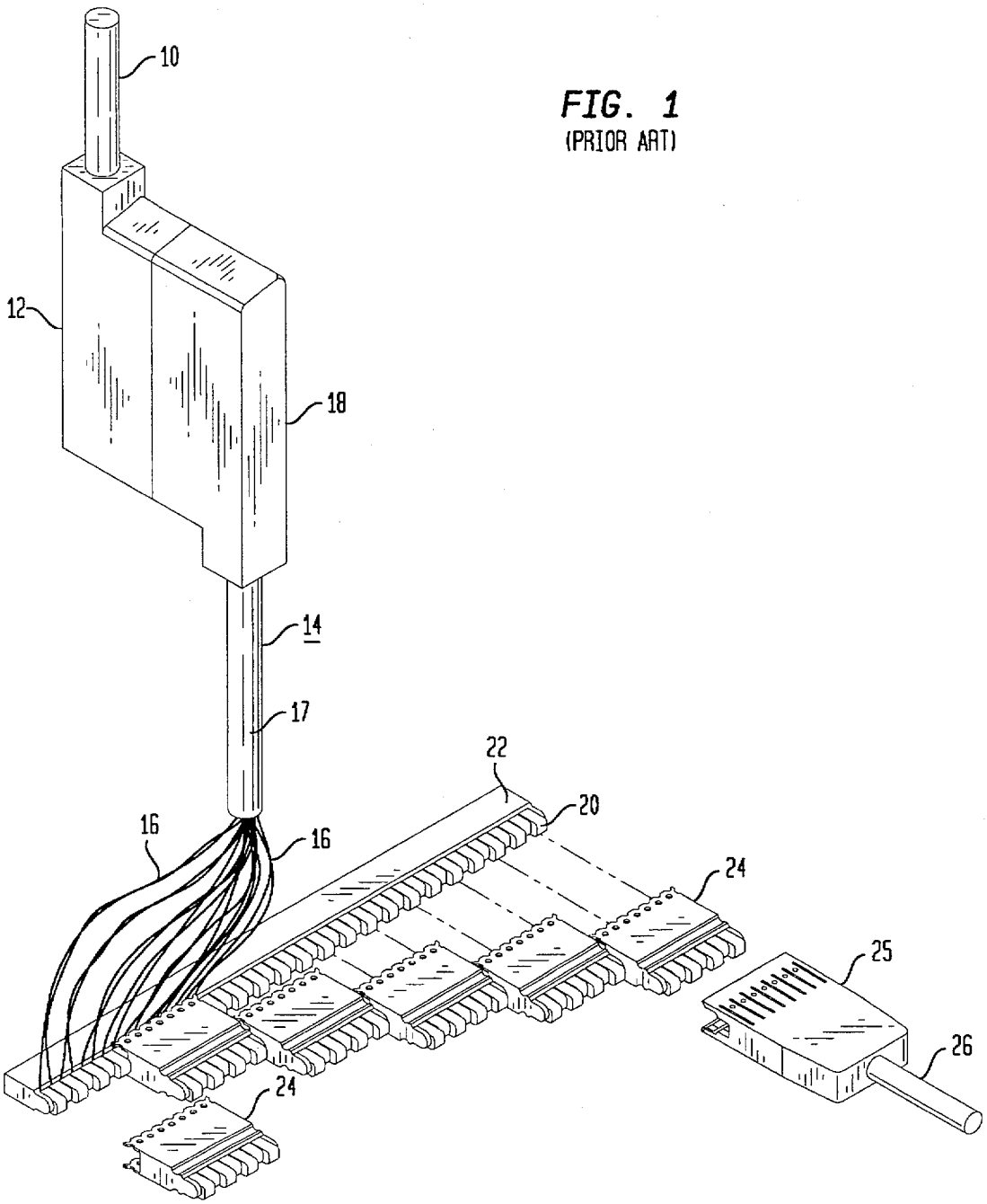
FIG. 1 (PRIOR ART)
FIG. 1 shows a prior art cable interconnection assembly.
Figure 4A:
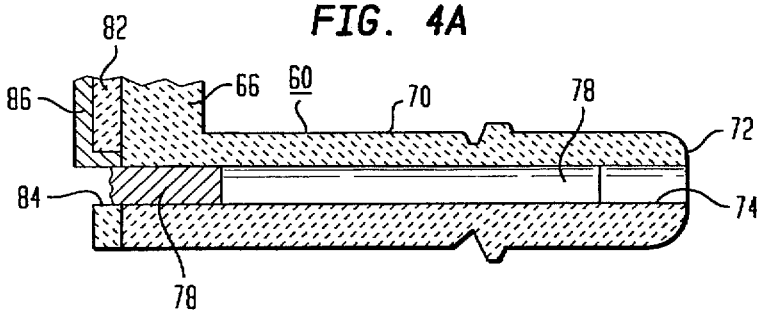
FIG. 4A is a cross-section, on an enlarged scale and partly broken away, of a portion of the front wall module shown in FIG. 4.

The connector module 60 is a one piece injection molded component (similarly as the base member 34) comprising (in the orientation shown) a vertically extending plate 66 joined to a horizontally extending plate 70. Preferably, the plate 70 is identical to a commercially available connector component known as a "connecting block", type "110". A leading edge 72 of the plate 70 is formed into a number of side-by-side protrusions designed for snap-action mating with known "patching connectors" such as shown at 25 in FIG. 1. The entire plate 70 is of a dielectric material, but it contains a plurality of side-by-side cavities 74 (FIG. 4A) extending entirely through the plate 70, from front-to-back, and continuing, in this embodiment, entirely through the vertical plate 66. In FIG. 4A, elongated wire terminals 78 (also, see FIG. 3) are shown extending through the cavities 74 for exposure at the leading edge 72 of the plate 70. The exposed portions of the terminals are for making electrical connections to mating connectors in the aforementioned patching connectors 25 (FIG. 1). As shown in FIG. 4, the wire terminals 78 are of the known "spring leaf" type, i.e., a bifurcated member for tight fit of an extending blade-like mating connector from the patching connector.

The connector module 60 can be of other configurations for use with other types of electrical connecting arrangements.

The printed circuit board 62 (FIG. 3) can be of generally known construction including an elongated plate 82 of a dielectric material such as a known epoxy/fiberglass matrix. The plate 82 is substantially identical in dimensions to the vertical plate 66 of the connector module 60 and includes a plurality of side-by-side openings 84 extending entirely through the plate 82. The circuit board openings 84 are aligned with respective cavities 74 (FIG. 4A) through the connector module 60, and rearwardly extending ends 78*a* (FIG. 3) of the aforementioned wire terminals 78 are snugly and fixedly disposed within respective openings 84 through the plate 82. When the printed circuit board 62 is in assembled relation with the connector module 60, bifurcated ends 78*b* of the various wire terminals 78 project forwardly from the printed circuit board plate 82 to fit snugly within and through the connecting block cavities 74, as aforedescribed.

The walls of the openings 84 through the printed circuit plate 82 are coated (FIG. 4A) with a layer 86 of metal, e.g., copper or a lead-tin solder. The metal layers thus make electrical contacts with the wire terminals 78 fixedly disposed within the openings 84 and provide electrical connections, via metal path extensions 86 (FIG. 3) of the metal layers, to metal coated walls of prong receiving openings 88 extending entirely through the plate 82 and disposed, in two parallel lines, adjacent to an edge 90 of the plate 82.

The mating connector 64 includes, in this embodiment, two lines of side-by-side prongs 92 for snug fit within respective ones of the prong openings 88 of the circuit board 62. The prongs 92 extend entirely through the body of the connector 64 and extend rearwardly outwardly in a two line array of prongs similar to the array of prongs on the front side of the connector 64 as visible in FIG. 3. When a front wall module 38 is in an assembled together condition, as shown in FIG. 4, each connector 64 prong 92 (visible in FIG. 3) is electrically connected, via the printed circuit board 62, with a corresponding terminal 78 projecting forwardly through and accessible at the front of the connector module 60.

As previously described, cable connectors 46 (FIG. 4) are to be disposed in respective slots 52 in the rear wall 34 of the base member 32. In this embodiment, the cable connectors 46 include a two line array of terminals 48, of the aforementioned leaf spring type, fixedly molded within the connector 46. The array of leaf spring terminals 48 corresponds to the array of prongs 92 extending rearwardly from the mating connector 64, and when each front wall module 38 is mounted on the base member, the mating connector prongs 92 enter into and make surface contact and electrical connection with the leaf spring terminals 48 of the cable connector 46. This provides electrical connections between the wires of the cable 42 and respective terminals 78 at the front of the assembly 30. While different types of connectors 46 and 64 can be used, obviously, the two connectors 46 and 64 must be compatible with one another.

Advantages of the cable interconnection assembly 30 are its neatness, compactness and ease of assembly. As shown in FIG. 5, a plurality of cables 42 can be terminated within the assembly 30 with no bare wires showing as in the prior art arrangement shown in FIG. 1. A corresponding plurality of connector modules 60 are neatly disposed at the front of the assembly for connection by snap-action connectors of the type shown at 25 in FIG. 1. Although the assembly 30 is not fully closed, significant protection against dirt is provided.

The actual patterns of interconnections between the wires within the cables 42 and the assembly front terminals 78 is determined by the pattern of conductive paths on the circuit board 62. Circuit boards are known commercially available electrical components, and can be fabricated with any selected pattern of connections between the two pairs of terminals in the board, e.g., the various prong openings 88 and the contacts 78. As known, insulated crossings of various conductor paths are obtainable by the use of a multi-layered circuit board plate 82 with various conductive paths on respective layers of the plate. Thus, not only can conductive paths cross one another (by being disposed on separate plate layers), but multiple connections can be made amongst the terminals. For example, any terminal 78 on the board 62 can be connected to one or more other terminals 78 or prong openings 88 on the board.

As shown in FIGS. 3 and 4, the circuit board plate 82 is disposed in vertical orientation and in full surface contact with the vertical plate 66 of the circuit module 60. The two plates 82 and 66 are removably held in place by frictional fit of the circuit board contacts 78 (FIG. 3) within the circuit module cavities 74 (FIG. 4A) and the two plates 82 and 66 comprise the vertical wall portion of the front wall modules 38. The modules 38 are mounted (FIG. 5) on the base member by means of snap motion latches 96.

Figure 6:
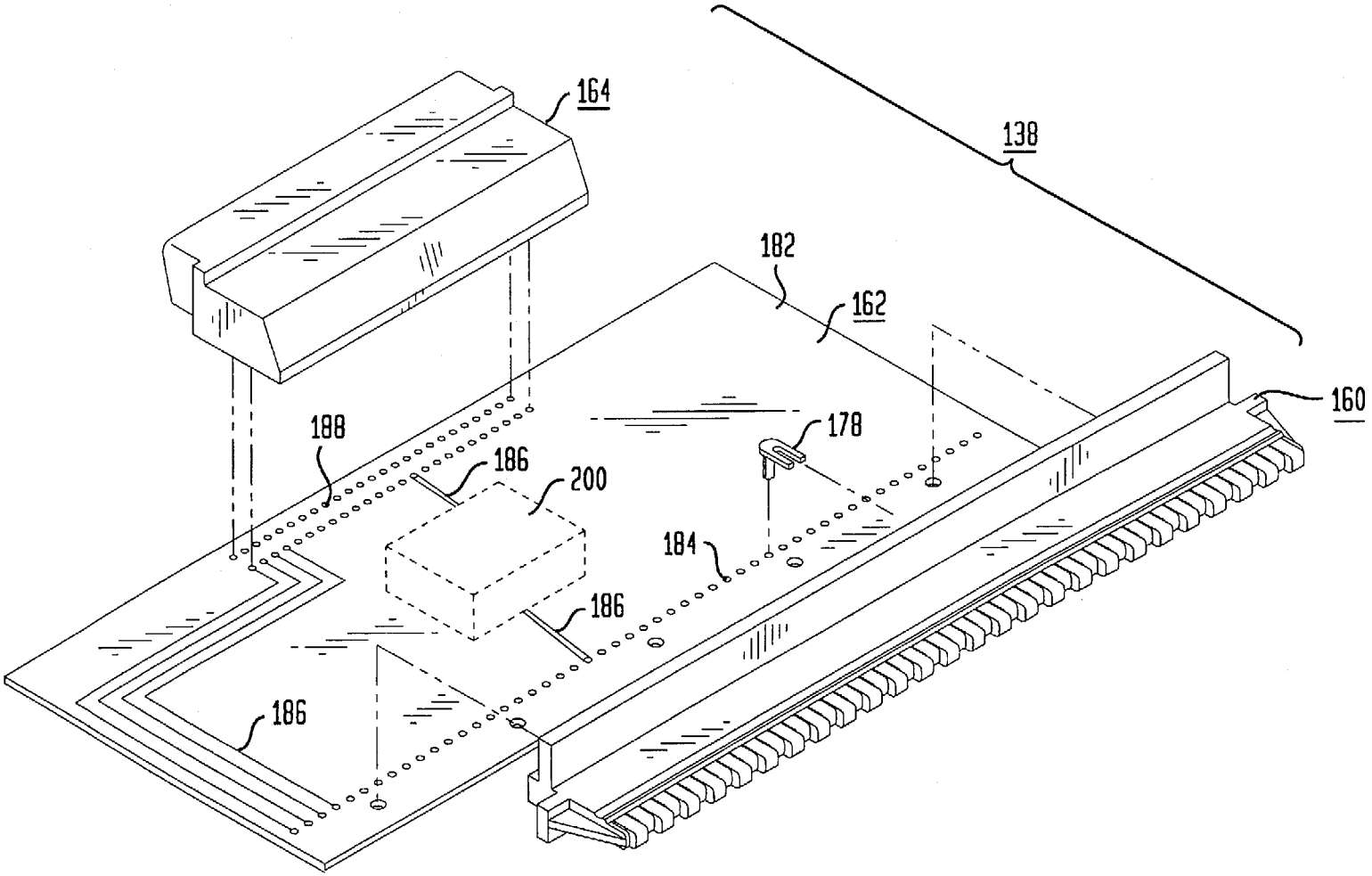
FIGS. 6 and 7 are similar to FIGS. 3 and 4, respectively, but showing another embodiment of a cable interconnection assembly according to the present invention.
Figure 7:
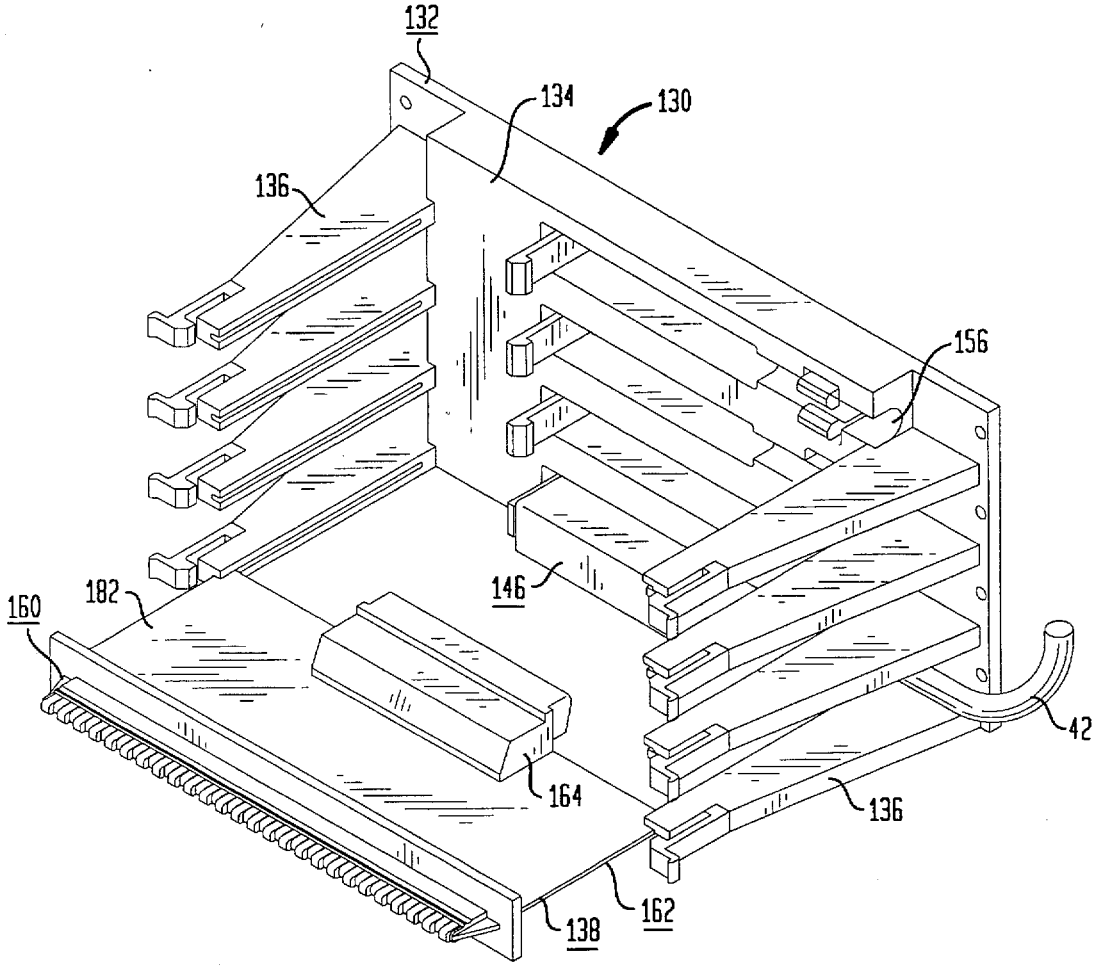

Portions of another cable interconnection assembly 130 are shown in FIGS. 6 and 7. Except as hereinafter described, the assembly 130 is substantially identical to the previously described assembly 30. The assembly 130 includes a printed circuit board 162 including a flat plate 182 which is larger than the circuit board plate 82 shown in FIG. 3 and which extends rearwardly from a connector module 160.

A mating connector 164 is mounted at the rear end of the circuit board plate 182 by means of in-line prongs (not visible) inserted vertically downwardly into prong openings 188 through the plate 182. In this embodiment, because the circuit board plate 182 extends horizontally towards a vertically disposed cable connector 146 (FIG. 7) mounted on a rear wall 134 of a base member 132, the prongs of the connector 164 make a right angle bend within the connector 164 for facing rearwardly towards the cable connector 146. The mating connector 164 can be of commercially available type, e.g., a right angle miniature ribbon. Similarly, because of the horizontal orientation of the circuit board plate 182 relative to the connector module 160, connector terminals 178 (only one shown in FIG. 6) rigidly mounted within openings 184 through the plate 182 are right-angled for projecting both vertically downwardly through the openings 184 and horizontally forwardly through the connector module 160.

As shown in FIG. 7, the front wall module 138 is to be assembled onto a base member 132 somewhat similar to the base member 32 shown in FIGS. 2 and 4 but deeper to accommodate the horizontal and rearwardly extending circuit board 162.

An advantage of the front wall module 138 in the assembly 130 is that the horizontally extending circuit board plate 182 presents a convenient surface on which various electrical components (indicated schematically in FIG. 6 by a dashed line box 200) can be mounted and interconnected via prong terminals extending into metal lined prong openings (not shown, but similar to the prong openings 188) interconnected to conductive paths 186 disposed on (and within) the plate 182. Thus, not only can wires from respective front and rear cables be interconnected via the terminal assembly 130, but electrical components mounted on the circuit board plates 182 can be used for "processing", e.g., amplifying, electrical signals passing between the interconnected cable wires.

A further modification present within the assembly 130 is that sides of the base member 132 (FIG. 7) comprise spaced apart grooved members 136 mounted on and extending forwardly from the base member rear wall 134. As indicated in FIG. 7, the front wall modules 138 are mounted in place by sliding edges of the circuit board plates 182 within grooves of the side members 136.

What is claimed is:

1. A cable interconnection assembly comprising a box including a rear wall, side walls mounted on said rear wall and projecting forwardly thereof, and a composite front wall comprising a plurality of mating front wall modules, said rear wall containing a plurality of side by side parallel first slots and spring latch means associated with each said slot for removably receiving and rigidly retaining therein a cable connector, one of said side walls including a plurality of side-by-side second slots entirely through said one side wall and being aligned with respective ones of said rear wall slots for routing connector terminated cables outwardly from said box, each of said front wall modules comprising an elongated first member for being disposed parallel to said rear wall for forming said composite front wall, each said first member having two oppositely disposed surfaces, one of which faces outwardly of said box when said front wall module is in place on the box and the other of which faces inwardly of said box towards said rear wall thereof, a printed circuit board mounted on said other surface of said first member and including a plurality of electrically conductive paths thereon connected to respective wire terminals mounted on said circuit board and extending therefrom entirely through said first member for being accessible at said outwardly facing surface thereof, and a first connector mounted on said printed circuit board for mating with a cable connector received within said box, said first connector including a plurality of terminals connected to respective ones of said conductive paths for being electrically connected to respective ones of said wire terminals mounted on said circuit board.

2. An assembly according to claim 1 wherein said first slots are disposed within a forwardly facing surface of said rear wall and extend to a side surface of said rear wall.

3. An assembly according to claim 2 wherein each of two oppositely disposed side walls of said box comprises a plurality of spaced apart members mounted on and projecting forwardly from said rear wall, each of the members of one of said side walls being in coplanar relationship with a corresponding member of the other of said walls, and each pair of corresponding members having grooves therein for sliding fit of side edges of a printed circuit board of a front wall module mounted on said box.

4. A cable interconnection assembly comprising a box including a base member providing a rear wall and side walls mounted on said rear wall and projecting forwardly thereof, and a composite front wall comprising a plurality of mating front wall modules, said rear wall containing a plurality of side by side parallel receptacles, each for removably receiving and rigidly retaining therein a cable connector, one of said base member walls including a plurality of side-by-side first slots entirely therethrough and being aligned with respective ones of said rear wall receptacles for routing connector terminated cables outwardly from said box, each of said front wall modules comprising an elongated first member for being disposed parallel to said rear wall for forming said composite front wall, each said first member having two oppositely disposed surfaces, one of which faces outwardly of said box when said front wall module is in place on the box and the other of which faces inwardly of said box towards said rear wall thereof, a printed circuit board mounted on said other surface of said first member and including a plurality of electrically conductive paths thereon connected to respective wire terminals mounted on said circuit board and extending therefrom entirely through said first member for being accessible at said outwardly facing surface thereof, and a first connector mounted on said printed circuit board for mating with a cable connector received within said box, said first connector including a plurality of terminals connected to respective ones of said conductive paths for being electrically connected to respective ones of said wire terminals mounted on said circuit board.

5. An assembly according to claim 4 wherein said receptacles comprise second slots disposed within a forwardly facing surface of said rear wall.

6. An assembly according to claim 4 wherein each of two oppositely disposed side walls of said box comprises a plurality of spaced apart members mounted on and projecting forwardly from said rear wall, each of the members of one of said side walls being in coplanar relationship with a corresponding member of the other of said walls, and each pair of corresponding members having grooves therein for sliding fit of side edges of a printed circuit board of a front wall module mounted on said box.

7. An assembly according to claim 4 wherein said circuit board is mounted on said first member to extend transversely thereof towards said base member, and said circuit board providing a surface for the mounting of electrical components for electrical interconnections with said conductive paths on said circuit board.

* * * * *